US010996587B2

(12) United States Patent
Aso et al.

(10) Patent No.: US 10,996,587 B2
(45) Date of Patent: May 4, 2021

(54) IMAGE FORMING APPARATUS WITH A PLURALITY OF DEVELOPER CONTAINER EACH HAVING AN ENGAGEMENT PORTION

(71) Applicants: Kazuhiro Aso, Kanagawa (JP); Toshio Koike, Tokyo (JP); Teppei Kikuchi, Kanagawa (JP)

(72) Inventors: Kazuhiro Aso, Kanagawa (JP); Toshio Koike, Tokyo (JP); Teppei Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/884,215

(22) Filed: May 27, 2020

(65) Prior Publication Data

US 2021/0018860 A1 Jan. 21, 2021

(30) Foreign Application Priority Data

Jul. 16, 2019 (JP) ..... JP2019-130857

(51) Int. Cl.
*G03G 15/08* (2006.01)

(52) U.S. Cl.
CPC ..... *G03G 15/0867* (2013.01); *G03G 15/0896* (2013.01)

(58) Field of Classification Search
CPC ..... G03G 15/0863; G03G 15/0867; G03G 15/0896
USPC ..... 399/12, 13
See application file for complete search history.

(56) References Cited

U.S. PATENT DOCUMENTS 8,655,198 B2 * 2/2014 Yannane et al. ... G03G 15/0863 399/12
8,699,890 B2 * 4/2014 Okamoto ..... G03G 15/0855 399/12
2013/0243491 A1 9/2013 Nodera et al.
2014/0320906 A1 10/2014 Fujimori et al.
(Continued)

FOREIGN PATENT DOCUMENTS

JP 5-158346 6/1993
JP 2014-123055 7/2014
(Continued)

*Primary Examiner* — William J Royer
(74) *Attorney, Agent, or Firm* — Oblon, McClelland, Maier & Neustadt, L.L.P.

(57) ABSTRACT

An image forming apparatus includes a plurality of developer containers to contain different types of developers and a container mount in which the plurality of developer containers is removably installed and arranged adjacent to each other. Each of the developer containers includes an engagement portion. The engagement portion of one of the developer containers engages the engagement portion of another of the developer containers adjacent to the one of the developer containers when the developer containers are installed in the container mount in a predetermined order, to allow the developer containers to be installed. Further, the engagement portion of one of the developer containers interferes with the engagement portion of another of the developer containers adjacent to the one of the developer containers when the developer containers are installed in the container mount in a different order from the predetermined order, to prevent the developer containers from being installed.

6 Claims, 5 Drawing Sheets

(56) References Cited

U.S. PATENT DOCUMENTS

| | | | |
|---|---|---|---|
| 2014/0321885 | A1 | 10/2014 | Fujimori et al. |
| 2014/0321886 | A1 | 10/2014 | Kikuchi et al. |
| 2015/0261134 | A1 | 9/2015 | Kikuchi et al. |
| 2015/0323884 | A1 | 11/2015 | Kikuchi et al. |
| 2016/0223946 | A1 | 8/2016 | Kikuchi et al. |
| 2017/0227885 | A1 | 8/2017 | Yamabe et al. |
| 2017/0363987 | A1 | 12/2017 | Nodera et al. |
| 2019/0064699 | A1 | 2/2019 | Nodera et al. |
| 2019/0339642 | A1 | 11/2019 | Takami et al. |

FOREIGN PATENT DOCUMENTS

| | | |
|---|---|---|
| JP | 2014-130223 | 7/2014 |
| JP | 2014-164037 | 9/2014 |
| JP | 2016-038560 | 3/2016 |

* cited by examiner

IMAGE FORMING APPARATUS WITH A PLURALITY OF DEVELOPER CONTAINER EACH HAVING AN ENGAGEMENT PORTION

CROSS-REFERENCE TO RELATED APPLICATION

This patent application is based on and claims priority pursuant to 35 U.S.C. § 119(a) to Japanese Patent Application No. 2019-130857, filed on Jul. 16, 2019, in the Japan Patent Office, the entire disclosure of which is hereby incorporated by reference herein.

BACKGROUND

Technical Field

Embodiments of the present disclosure generally relate to an image forming apparatus such as a copier, a printer, a facsimile machine, or a multifunction peripheral (MFP) having at least two of such capabilities.

Description of the Related Art

There are image forming apparatuses, such as copiers, printers, and the like, in which a plurality of developer containers is removably installed. The plurality of developer containers, which is replaceable, contains different types of developers.

SUMMARY

Embodiments of the present disclosure describe an improved image forming apparatus that includes a plurality of developer containers configured to contain different types of developers and a container mount in which the plurality of developer containers is removably installed and arranged adjacent to each other. Each of the plurality of developer containers includes an engagement portion. The engagement portion of one of the plurality of developer containers is configured to engage the engagement portion of another of the plurality of developer containers disposed adjacent to the one of the plurality of developer containers when the plurality of developer containers is installed in the container mount in a predetermined order, to allow the plurality of developer containers to be installed. Further, the engagement portion of one of the plurality of developer containers is configured to interfere with the engagement portion of another of the plurality of developer containers disposed adjacent to the one of the plurality of developer containers when the plurality of developer containers is installed in the container mount in a different order from the predetermined order, to prevent the plurality of developer containers from being installed.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
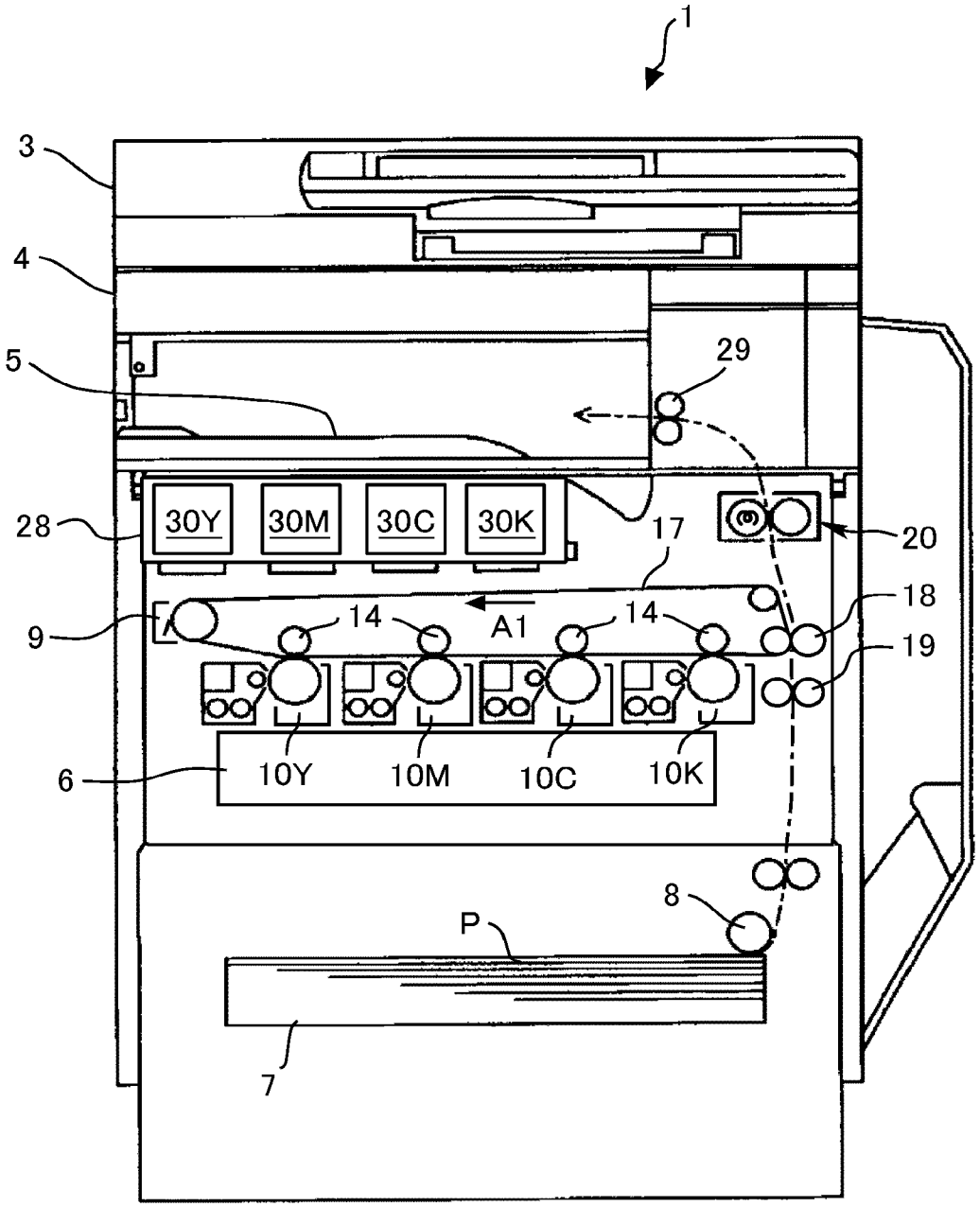
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views, and redundant descriptions are omitted or simplified below as required.

DETAILED DESCRIPTION

Embodiments of the present disclosure are described in detail with reference to drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

A configuration and operation of an image forming apparatus 1 is described below with reference to FIG. 1.

In FIG. 1, the image forming apparatus 1, which is a color copier in the present embodiment, includes a document conveyance device 3, a scanner (document reading device) 4, and an exposure device (writing device) 6. The document conveyance device 3 conveys documents to the scanner 4. The scanner 4 scans image data for the documents. The exposure device 6 emits a laser beam based on input image data.

The image forming apparatus 1 also includes a sheet feeder 7, process cartridges 10Y, 10M, 10C, and 10K, an intermediate transfer belt 17, a secondary transfer roller 18, and a fixing device 20. The sheet feeder 7 accommodates sheets of paper P or the like. The process cartridges 10Y, 10M, 10C, and 10K are image forming units to form yellow, magenta, cyan, and black toner images, respectively. The intermediate transfer belt 17 serves as an image bearer onto which the toner images of multiple colors are transferred and superimposed. The secondary transfer roller 18 transfers the toner images on the intermediate transfer belt 17 to the sheet P. The fixing device 20 fixes unfixed toner images on the sheet P.

The image forming apparatus 1 further includes a container mount 28, a plurality of toner containers 30Y, 30M, 30C, and 30K as a plurality of developer containers. The plurality of toner containers 30Y, 30M, 30C, and 30K is removably installed in the container mount 28 to supply toners as developers of respective colors to developing devices of the corresponding process cartridges 10Y, 10M, 10C, and 10K.

Figure 2:
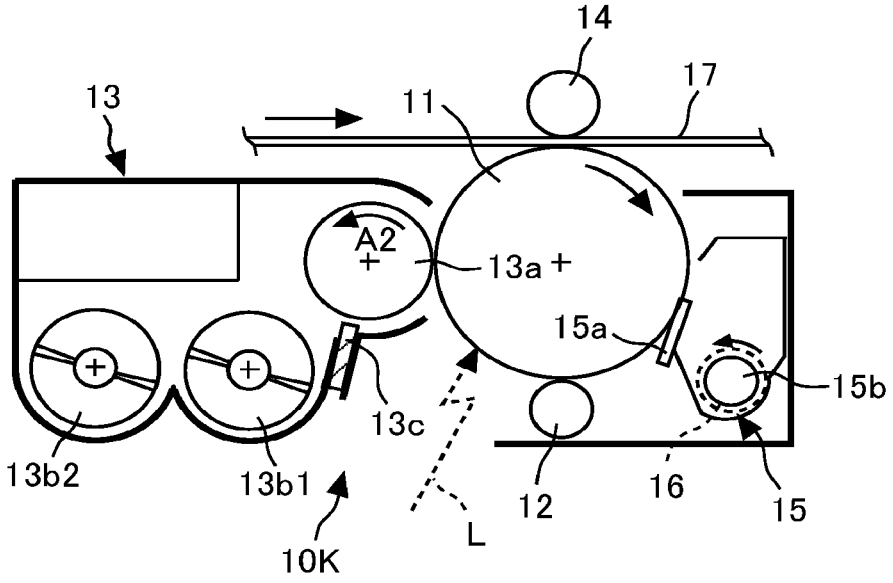
FIG. 2 is a schematic view illustrating a configuration of an image forming unit of the image forming apparatus in FIG. 1.

Each of the process cartridges (image forming units) 10Y, 10M, 10C, and 10K includes a photoconductor drum 11 as an image bearer, a charging device 12, a developing device 13, and a cleaning device 15, which are united as a single unit as illustrated in FIG. 2. Each of the process cartridges 10Y, 10M, 10C, and 10K, which is expendable, is replaced with a new one when depleted. In the process cartridges 10Y, 10M, 10C, and 10K, yellow, magenta, cyan, and black toner images are formed on the respective photoconductor drums (image bearers) 11.

A description is provided below of the operation of the image forming apparatus 1 to form a normal color image. A conveyance roller of the document conveyance device 3 conveys a document on a document table onto a platen (exposure glass) of the scanner 4. Then, the scanner 4 optically scans image data for the document on the platen. The yellow, magenta, cyan, and black image data are transmitted to the exposure device 6. The exposure device 6 irradiates the photoconductor drums 11 of the corresponding process cartridges 10Y, 10M, 10C, and 10K with laser beams (exposure light) L based on the yellow, magenta, cyan, and black image data, respectively.

Meanwhile, the four photoconductor drums 11 rotate clockwise in FIGS. 1 and 2. With reference to FIG. 2, it can be seen that the charging device 12 (e.g., a charging roller) uniformly charges the surface of the photoconductor drum 11 at a position opposite each other (charging process). Thus, the surface of the photoconductor drum 11 is charged to a certain potential. Subsequently, the surface of the photoconductor drum 11 thus charged reaches a position where the surface of the photoconductor drum 11 is irradiated with the laser beam L.

The exposure device 6 emits the laser beams L for respective colors from a light source according to the image data. The laser beams L are reflected by a polygon mirror and transmitted through multiple lenses. The transmitted laser beams L pass through different optical paths for the different components of yellow, magenta, cyan, and black (exposure process).

The laser beam L corresponding to a yellow component is directed to the surface of photoconductor drum 11 in the process cartridge 10Y, which is the first from the left in FIG. 1 among the four process cartridges 10Y, 10M, 10C, and 10K. Thus, an electrostatic latent image for yellow is formed on the photoconductor drum 11 charged by the charging device 12.

Similarly, the laser beam L corresponding to a magenta component is directed to the surface of the photoconductor drum 11 in the second process cartridge 10M from the left in FIG. 1, thus forming an electrostatic latent image for magenta on the photoconductor drum 11. The laser beam L corresponding to a cyan component is directed to the surface of the photoconductor drum 11 in the third process cartridge 10C from the left in FIG. 1, thus forming an electrostatic latent image for cyan on the photoconductor drum 11. The laser beam L corresponding to a black component is directed to the surface of the photoconductor drum 11 in the fourth process cartridge 10K from the left in FIG. 1, thus forming an electrostatic latent image for black on the photoconductor drum 11.

Then, the surface of the photoconductor drum 11 having the electrostatic latent image reaches a position opposite the developing device 13 (see FIG. 2). The developing device 13 deposits toner of each color onto the surface of the photoconductor drum 11 and develops the electrostatic latent image on the photoconductor drum 11 into a toner image (development process).

Subsequently, the surface of the photoconductor drum 11 after the development process reaches a position facing the intermediate transfer belt 17 as the image bearer. Primary transfer rollers 14 are disposed at positions where the photoconductor drums 11 face the intermediate transfer belt 17 and in contact with an inner circumferential face of the intermediate transfer belt 17, respectively. At the positions of the primary transfer rollers 14, the toner images on the photoconductor drums 11 are transferred to and superimposed on the intermediate transfer belt 17, forming a multicolor toner image thereon (primary transfer process).

After the primary transfer process, the surface of the photoconductor drum 11 reaches a position opposite the cleaning device 15 (see FIG. 2). The cleaning device 15 collects untransferred toner remaining on the photoconductor drum 11 (cleaning process). Then, the surface of the photoconductor drum 11 passes through a discharge device to complete a series of image forming processes performed on the photoconductor drum 11.

Meanwhile, the surface of the intermediate transfer belt 17, onto which the single-color toner images on the photoconductor drums 11 are superimposed, moves in the direction indicated by arrow A1 in FIG. 1 and reaches a position opposite the secondary transfer roller 18. The secondary transfer roller 18 secondarily transfers the multicolor toner image on the intermediate transfer belt 17 to the sheet P (secondary transfer process). After the secondary transfer process, the surface of the intermediate transfer belt 17 reaches a position opposite a belt cleaning device 9. The belt cleaning device 9 collects untransferred toner on the intermediate transfer belt 17 to complete a series of transfer processes on the intermediate transfer belt 17.

The sheet P is conveyed to the position of the secondary transfer roller 18, via a sheet conveyance guide, a registration roller pair 19, and the like, from the sheet feeder 7. More specifically, a sheet feeding roller 8 feeds the sheet P from the sheet feeder 7 that accommodates a stack of sheets P, and the sheet P is then guided by the sheet conveyance guide to the registration roller pair 19. The sheet P that has reached the registration roller pair 19 is conveyed toward the position of the secondary transfer roller 18, timed to coincide with the arrival of the multicolor toner image on the intermediate transfer belt 17.

Subsequently, the sheet P, onto which the multicolor image is transferred, is conveyed to the fixing device 20. The fixing device 20 includes a fixing roller and a pressure roller pressing against each other. In a nip between the fixing roller and the pressure roller, the multicolor toner image is fixed on the sheet P. After the fixing process, an output roller pair 29 ejects the sheet P as an output image to the exterior of the image forming apparatus 1, and the ejected sheet P is stacked on an output tray 5 to complete a series of image forming processes.

Next, the process cartridge (image forming unit) 10K of the image forming apparatus 1 is described in further detail below with reference to FIG. 2. FIG. 2 is a schematic view of the process cartridge 10K for black. The other three process cartridges 10Y, 10M, and 10C have a similar configuration to that of the process cartridge 10K for black except for the color of toner used in image forming processes, and thus drawing and descriptions thereof are omitted to avoid redundancy.

As illustrated in FIG. 2, the process cartridge 10K is a single unit that accommodates the photoconductor drum 11 as the image bearer, the charging device 12 to charge the photoconductor drum 11, the developing device 13 to develop the electrostatic latent image on the photoconductor drum 11, the cleaning device 15 to remove untransferred toner from the photoconductor drum 11 in a casing of the process cartridge 10K.

The photoconductor drum 11 used in the present embodiment is an organic photoconductor designed to be charged with a negative polarity and which includes a photosensitive layer formed on a drum-shaped conductive support. The charging device 12 is the charging roller including a conductive core and an elastic layer of moderate resistivity coated on the conductive core. Receiving a predetermined voltage from a power supply, the charging device 12 uniformly charges the surface of the photoconductor drum 11 opposite the charging device 12.

The developing device 13 includes a developing roller 13*a* disposed opposite the photoconductor drum 11, a first conveying screw 13*b*1 disposed opposite the developing roller 13*a*, a second conveying screw 13*b*2 disposed opposite the first conveying screw 13*b*1 via a partition, and a doctor blade 13*c* disposed opposite the developing roller 13*a*. The developing roller 13*a* includes multiple magnets and a sleeve that rotates around the magnets. The magnets are stationary and generate magnetic poles around the circumference of the developing roller 13*a*. The magnets generate a plurality of magnetic poles on the sleeve of the developing roller 13*a* to bear a developer on the developing roller 13*a*. The developing device 13 contains the two-component developer including carrier and toner.

The cleaning device 15 includes a cleaning blade 15*a* that contacts the photoconductor drum 11, and a conveying screw 15*b* disposed in a conveyance tube 16 to convey untransferred toner collected in the cleaning device 15 as excess toner toward an excess toner receptacle. For example, the cleaning blade 15*a* is made of rubber, such as urethane rubber, and contacts the surface of the photoconductor drum 11 at a predetermined angle and with a predetermined pressure.

Similarly, the belt cleaning device 9 illustrated in FIG. 1 includes a cleaning blade that contacts the intermediate transfer belt 17 and a conveying screw disposed in a conveyance tube 16 to convey untransferred toner collected in the belt cleaning device 9 as excess toner toward the excess toner receptacle.

The image forming processes are described in further detail below with continued reference to FIG. 2. The developing roller 13*a* rotates counterclockwise indicated by arrow A2 in FIG. 2. In the developing device 13, as the first and second conveying screws 13*b*1 and 13*b*2 arranged via the partition rotate, the developer is circulated in the longitudinal direction of the developing device 13, being stirred and mixed with toner supplied from the toner container 30K by a toner supply device. The longitudinal direction of the developing device 13 is perpendicular to the surface of the paper on which FIG. 2 is drawn.

Thus, the toner is triboelectrically charged and attracted to the carrier. Then, the toner is carried on the developing roller 13*a* together with the carrier. The developer carried on the developing roller 13*a* reaches the doctor blade 13*c*. The amount of the developer on the developing roller 13*a* is adjusted to a suitable amount by the doctor blade 13*c*, after which the developer is transported to a development range opposite the photoconductor drum 11.

In the development range, toner in the developer adheres to the electrostatic latent image on the surface of the photoconductor drum 11. Specifically, the toner adheres to the electrostatic latent image by a development electric field formed by a potential difference (i.e., a developing potential) between a latent image potential (i.e., an exposure potential) of an image area irradiated with the laser beam L and a development bias applied to the developing roller 13*a*, thereby forming a toner image.

Subsequently, most of the toner that adheres to the photoconductor drum 11 in the development process is transferred to the intermediate transfer belt 17, and untransferred toner remaining on the photoconductor drum 11 is collected in the cleaning device 15 by the cleaning blade 15*a*.

The configuration and operation of the image forming apparatus 1 according to the present embodiment are described in further detail below. As illustrated in FIG. 1, a plurality of toner containers 30Y, 30M, 30C, and 30K as a plurality of developer containers contains different types of toners as developers therein and is removably installed in the container mount 28 of the image forming apparatus 1. The respective toner containers 30Y, 30M, 30C, and 30K are arranged adjacent to each other.

Specifically, in the present embodiment, the four toner containers 30Y, 30M, 30C, and 30K contain toners (developers) of different colors. More specifically, with reference to FIGS. 1 and 3A, the toner container 30Y containing yellow toner is installed at the leftmost position in the container mount 28, and the toner container 30M containing magenta toner is installed adjacent to the right side of the toner container 30Y. Further, the toner container 30C containing cyan toner is installed adjacent to the right side of the toner container 30M, and the toner container containing black toner is installed adjacent to the right side of the toner container 30C and at the rightmost position in the container mount 28. That is, the four toner containers 30Y, 30M, 30C, and 30K are arranged side by side in the order of yellow (Y), magenta (M), cyan (C), and black (K) from the left in the container mount 28. In the present embodiment, the four toner containers 30Y, 30M, 30C, and 30K have a substantially rectangular-parallelepiped shape and are arranged in the horizontal direction in the container mount 28 so as not to rotate. Meanwhile, the container mount 28 has a substantially rectangular-parallelepiped concave shape.

The toner container 30Y for yellow supplies toner to the developing device 13 of the process cartridge 10Y for yellow via a toner conveyance path of the toner supply device for yellow. Similarly, the toner container 30M for magenta supplies toner to the developing device 13 of the process cartridge 10M for magenta via a toner conveyance path of the toner supply device for magenta. The toner container 30C for cyan supplies toner to the developing device 13 of the process cartridge 10C for cyan via a toner conveyance path of the toner supply device for cyan. The toner container 30K for black supplies toner to the developing device 13 of the process cartridge 10K for black via a toner conveyance path of the toner supply device for black. Note that the toner conveyance path of the toner supply device can employ a conveying screw, a conveying pump, or other types of conveyors to convey toner. When each of the toner containers 30Y, 30M, 30C, and 30K runs out of toner, or almost all toner therein is depleted, each of the toner containers 30Y, 30M, 30C, and 30K is detached from the container mount 28 (the image forming apparatus 1) and replaced with a new one.

Figure 3A:
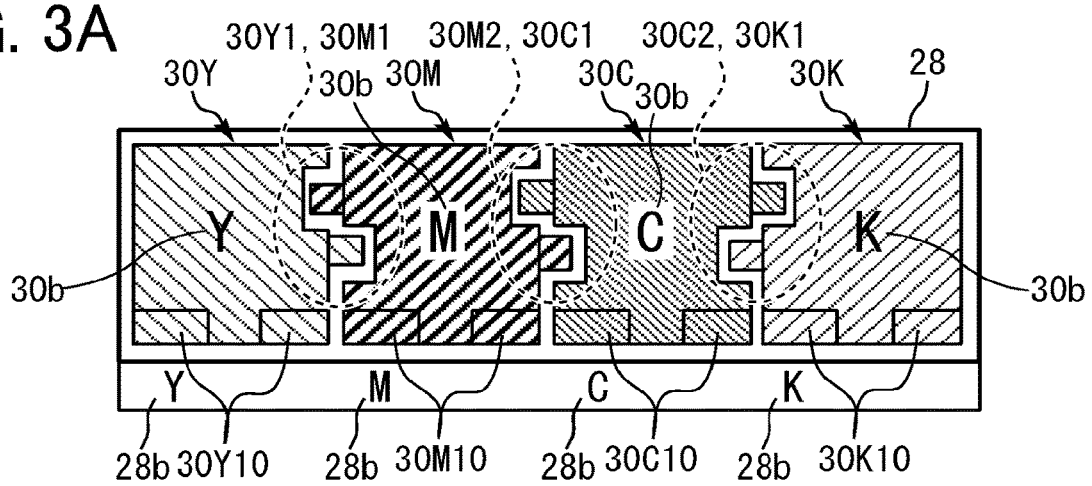
FIG. 3A is a front view of a plurality of toner containers that is correctly installed in a container mount of the image forming apparatus illustrated in FIG. 1.

As illustrated in FIG. 3A, the four toner containers 30Y, 30M, 30C, and 30K according to the present embodiment include concave-convex portions 30Y1, 30M1 and 30M2, 30C1 and 30C2, and 30K1 as engagement portions, respectively. The four toner containers 30Y, 30M, 30C, and 30K are arranged in the container mount 28 in the above-described predetermined order (i.e., Y, M, C, and K from the left in FIG. 3A). Each of the toner containers 30Y, 30M, 30C, and 30K is removably installed in the container mount 28 along a predetermined installation direction, which is perpendicular to the surface of the paper on which FIG. 3A is drawn and a vertical direction in FIGS. 4A and 4B. The concave-convex portions 30Y1, 30M1, 30M2, 30C1, 30C2, and 30K1 as the engagement portions are disposed across the entire area in the longitudinal direction (installation direction) of the toner containers 30Y, 30M, 30C, and 30K, respectively, extending along the installation direction.

Specifically, with reference to FIG. 3A, in the toner container 30Y for yellow according to the present embodiment, the left side of the toner container 30Y is substantially flat without the concave-convex portion, and the right side includes the concave-convex portion 30Y1 including an upper concave part and a lower convex part. In the toner container 30M for magenta, the left side of the toner container 30M includes the concave-convex portion 30M1 including an upper convex part and a lower concave part, and the right side includes the concave-convex portion 30M2 including an upper concave part and a lower convex part. In the toner container 30C for cyan, the left side of the toner container 30C includes the concave-convex portion 30C1 including an upper convex part and a lower concave part, and the right side includes the concave-convex portion 30C2 including an upper convex part and a lower concave part. In the toner container 30K for black, the left side of the toner container 30K includes the concave-convex portion 30K1 including an upper concave part and a lower convex part, and the right side is substantially flat without the concave-convex portion.

The concave-convex portions 30Y1, 30M1, 30M2, 30C1, 30C2, and 30K1 can be integrated with the casings of the toner containers 30Y, 30M, 30C, and 30K, respectively, or can be separate components that are bonded to the casings of the toner containers 30Y, 30M, 30C, and 30K in the assembling process.

As illustrated in FIG. 3A, the four toner containers 30Y, 30M, 30C, and 30K as the plurality of developer containers are installable in the container mount 28 in the predetermined order (e.g., Y, M, C, and K from the left) because the concave-convex portions as the engagement portions of two of the toner containers 30Y, 30M, 30C, and 30K disposed adjacent to each other engage each other (i.e., installable state).

Specifically, as illustrated in FIG. 3A, the concave-convex portion 30Y1 of the toner container 30Y for yellow engages the concave-convex portion 30M1 of the toner container 30M for magenta. Similarly, the concave-convex portion 30M2 of the toner container 30M for magenta engages the concave-convex portion 30C1 of the toner container 30C for cyan. Further, the concave-convex portion 30C2 of the toner container 30C for cyan engages the concave-convex portion 30K1 of the toner container 30K for black.

On the other hand, when the four toner containers 30Y, 30M, 30C, and 30K are going to be installed in the container mount 28 in a different order from the above-described predetermined order (e.g., Y, M, C, and K from the left), the concave-convex portions of two of the toner containers 30Y, 30M, 30C, and 30K disposed adjacent to each other interfere with each other. Therefore, the toner containers 30Y, 30M, 30C, and 30K are prevented from being erroneously installed (i.e., non-installable state).

Figure 3B:
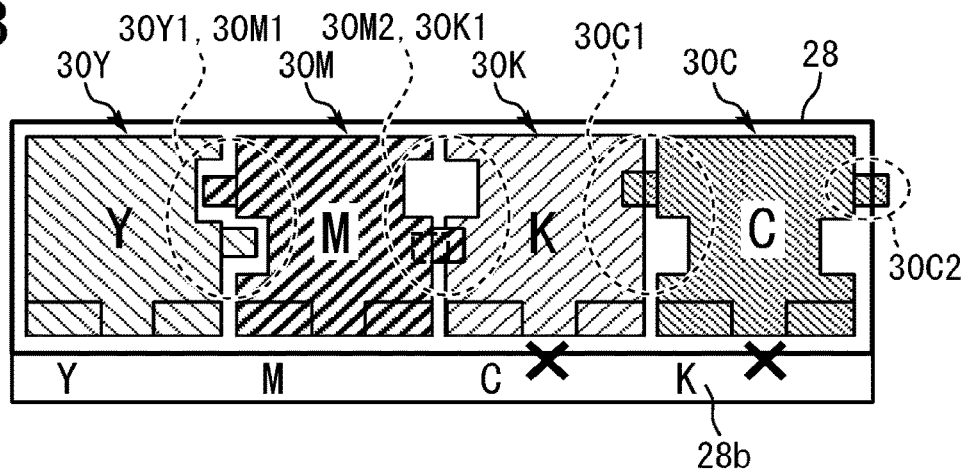
FIGS. 3B and 3C are front views of the plurality of toner containers that is incorrectly installed in the container mount of the image forming apparatus illustrated in FIG. 1.

In an example illustrated in FIG. 3B, the order of the toner container 30C for cyan and the toner container 30K for black is reversed, and four toner containers 30Y, 30M, 30C, and 30K are going to be installed in the container mount 28 in the order of Y, M, K, and C from the left. In this case, the concave-convex portion 30K1 of the toner container 30K for black interferes with the concave-convex portion 30M2 of the toner container 30M for magenta. The concave-convex portions 30C1 and 30C2 of the toner container 30C for cyan interfere with the toner containers 30K for black and the container mount 28, respectively. Therefore, the toner containers 30C, and 30K are prevented from being erroneously installed.

Figure 3C:
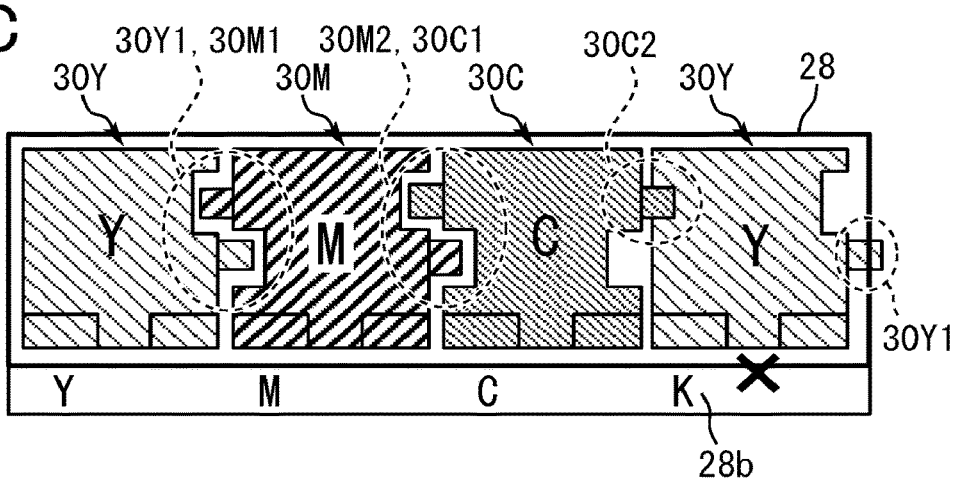

In another example illustrated in FIG. 3C, the toner container 30Y for yellow is going to be incorrectly installed instead of the toner container 30K for black, and the four toner containers 30Y, 30M, 30C, and 30Y are going to be installed in the container mount 28 in the order of Y, M, C, and Y from the left. In this case, the toner container 30Y for yellow interferes with the concave-convex portion 30C2 of the toner container 30C for cyan and the container mount 28. Therefore, the toner container 30Y is prevented from being erroneously installed.

It is to be noted that the "installable" state is a state in which the four toner containers 30Y, 30M, 30C, and 30Y have been completely installed, and the "non-installable" state is a state in which at least one of the four toner containers 30Y, 30M, 30C, and 30Y is prevented from being installed and the installation is incomplete.

As described above, in the present embodiment, the toner containers 30Y, 30M, 30C and 30K include the concave-convex portions 30Y1, 30M1 and 30M2, 30C1 and 30C2, and 30K1, respectively, that have incompatible shapes for respective colors to install the four toner containers 30Y, 30M, 30C and 30K in the container mount 28 in the correct order. On the other hand, the container mount 28 does not have an incompatible shape for respective colors, which is unnecessary, to engage the concave-convex portions of the toner containers 30Y, 30M, 30C and 30K. Therefore, the flexibility to design the container mount 28 is improved. Specifically, the container mount 28 does not need an additional shape such as the incompatible shape for respective colors and can have a simple, substantially rectangular-parallelepiped, concave box shape that fits the overall outer peripheral of all of the toner containers 30Y, 30M, 30C and 30K arranged in the correct order.

To improve the flexibility to design the container mount 28 also means that the flexibility to design the image forming apparatus 1 is improved. Accordingly, the space available in the image forming apparatus 1 is not limited, and the image forming apparatus 1 can be manufactured at reduced cost and downsized.

In the present embodiment, the plurality of toner containers (developer containers) 30Y, 30M, 30C, and 30K is installable in the container mount 28 in the predetermined order (e.g., Y, M, C, and K) because none of the plurality of toner containers 30Y, 30M, 30C, and 30K interfere with the container mount 28 (i.e., installable state). As described above with reference to FIGS. 3B and 3C, when the plurality of toner containers 30Y, 30M, 30C, and 30K are going to be installed in the container mount 28 in the different order from the above-described predetermined order (e.g., Y, M, C, and K), the concave-convex portion of at least one of the plurality of toner containers 30Y, 30M, 30C, and 30K interferes with the container mount 28 or the concave-convex portion of the adjacent toner container. Therefore, the toner containers 30Y, 30M, 30C, and 30K are prevented from being erroneously installed (i.e., non-installable state). As a result, the flexibility to design the container mount 28 (the image forming apparatus 1) is improved.

Further, in the present embodiment, the plurality of toner containers 30Y, 30M, 30C, and 30K include container-side marks 30*b* that are characters of "Y", "C", and "K" printed on the front face of the casing of the toner containers 30Y, 30M, 30C, and 30K, respectively, to identify type of toner container as illustrated in FIG. 3A. Further, the container mount 28 includes apparatus-side marks 28*b* indicating the above-described predetermined order (e.g., Y, M, C, and K as illustrated in FIG. 3A) or a position to install each of the plurality of toner containers 30Y, 30M, 30C, and 30K. As illustrated in FIG. 3A, the apparatus-side marks 28*b* are engraved on the side plate of the image forming apparatus 1 below an opening of the container mount 28, into which the toner containers 30Y, 30M, 30C, and 30K are inserted, in the order of "Y", "M", "C", and "K" from the left.

With this configuration, a user can clearly recognize the correct order of the four toner containers 30Y, 30M, 30C, and 30K, thereby preventing the user from setting the toner containers 30Y, 30M, 30C, and 30K erroneously. The container-side marks 30*b* and the apparatus-side marks 28*b* are not limited to the above-described configurations, and may have any configuration as long as the above-mentioned effects can be attained.

Figure 4A:
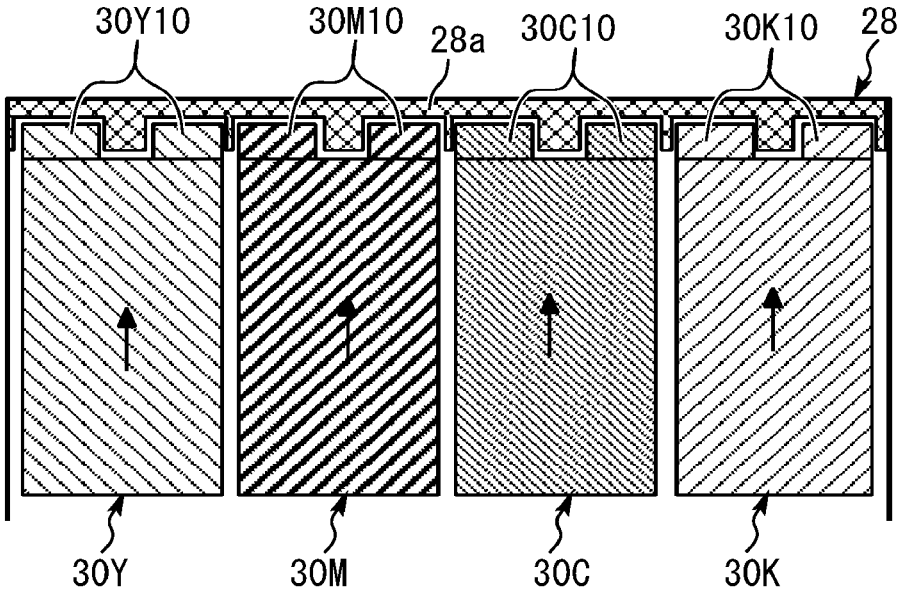
FIG. 4A is a cross-sectional view illustrating a state in which the plurality of toner containers for the image forming apparatus of the type illustrated in FIG. 1 is correctly installed in the container mount of the image forming apparatus of the same type when viewed from above.
Figure 5A:
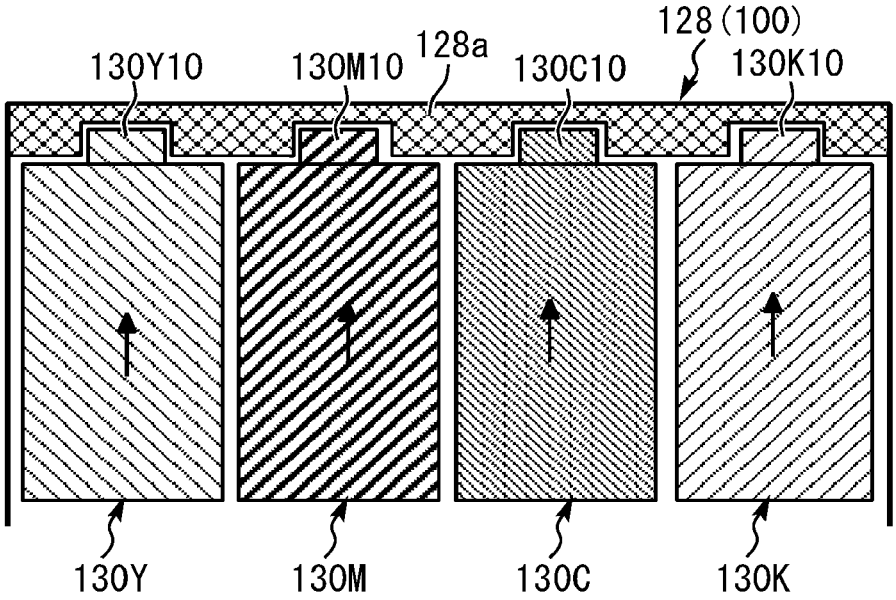
FIG. 5A is a cross-sectional view illustrating a state in which the plurality of toner containers illustrated in FIG. 4B for the image forming apparatus of the different type is correctly installed in a container mount of the image forming apparatus of the different type when viewed from above.
Figure 5B:
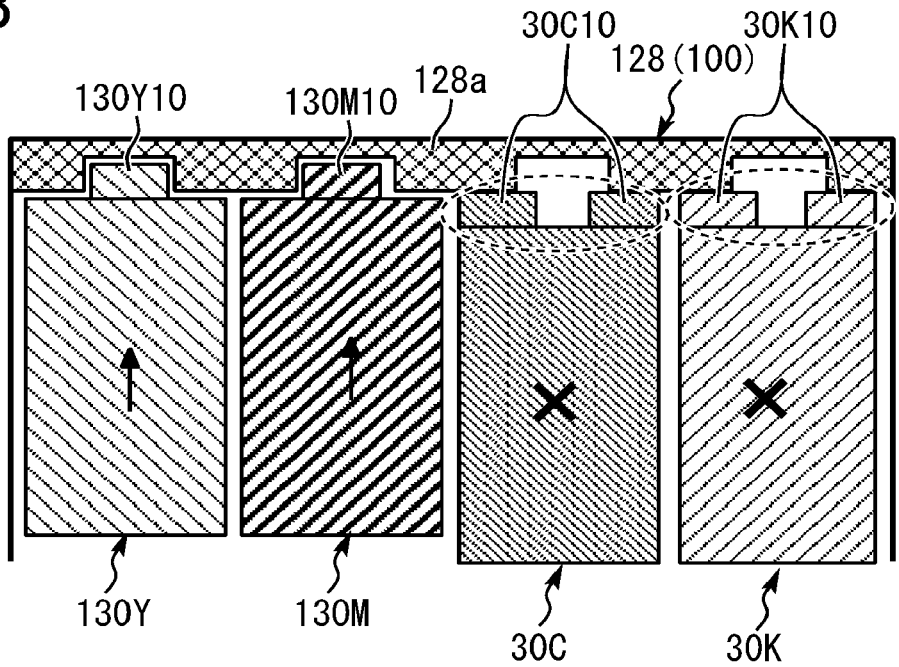
FIG. 5B is a cross-sectional view illustrating a state in which the toner containers for the image forming apparatus of the type illustrated in FIG. 1 are prevented from being installed in the container mount of the image forming apparatus of the different type when viewed from above.

With reference to FIGS. 3A, 4A, and 5B, in the present embodiment, the plurality of toner containers (developer containers) 30Y, 30M, 30C, and 30K includes container-side coupling portions 30Y10, 30M10, 30C10, and 30K10, respectively, having incompatible shapes for the image forming apparatus 1 of the same type that prevent the plurality of toner containers 30Y, 30M, 30C, and 30K from being installed in a container mount 128 of an image forming apparatus 100 of different type (see FIG. 5B).

Figure 4B:
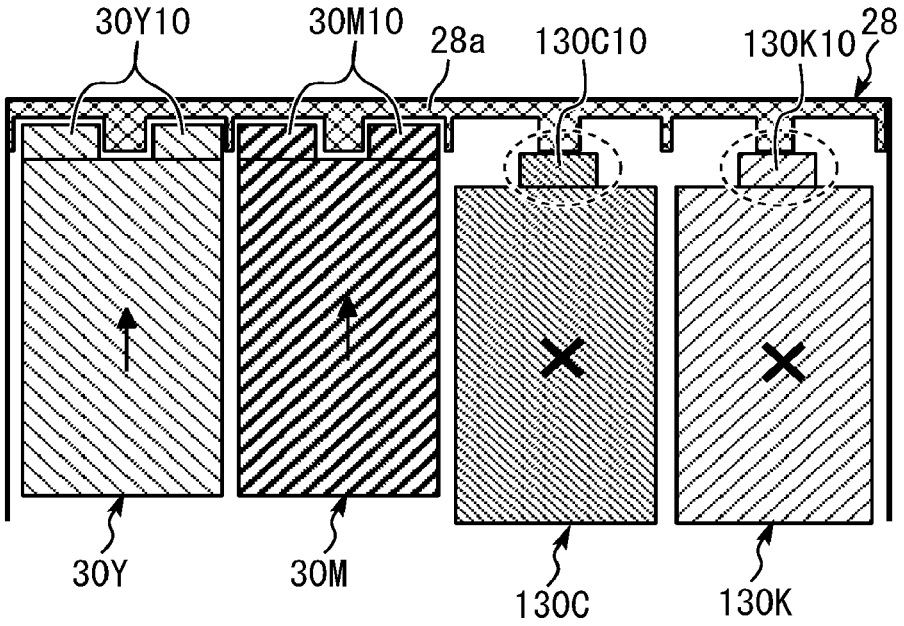
FIG. 4B is a cross-sectional view illustrating a state in which toner containers for an image forming apparatus of a different type are prevented from being installed in the container mount of the image forming apparatus of the type illustrated in FIG. 1 when viewed from above.

In addition, with reference to FIGS. 4A, and 4B, the container mount 28 includes an apparatus-side coupling portion 28*a* having an incompatible shape corresponding to the toner containers 30Y, 30M, 30C, and 30K. The apparatus-side coupling portion 28*a* and container-side coupling portions 130Y10, 130M10, 130C10, 130K10 (see FIG. 5A) interfere with each other to prevent a plurality of toner containers 130Y, 130M, 130C, and 130K (see FIG. 5A) for the image forming apparatus 100 of different type (see FIGS. 5A and 5B) from being installed in the container mount 28 of the image forming apparatus 1 of the same type. Further, the apparatus-side coupling portion 28*a* and the container-side coupling portions 30Y10, 30M10, 30C10, and 30K10 engage each other to allow the plurality of toner containers 30Y, 30M, 30C, and 30K for the image forming apparatus 1 of the same type to be installed in the container mount 28.

Specifically, the image forming apparatus 100 illustrated in FIGS. 5A and 5B is different from the image forming apparatus 1 illustrated in FIGS. 1 to 4B in type (e.g., specifications, destination area, etc.), and many parts are shared between the image forming apparatuses 1 and 100. However, it is necessary to prevent the toner containers from being used indistinguishably because of the difference in the composition of toner or the image forming conditions even if the same color toner is used in the image forming apparatuses 1 and 100. That is, the first toner containers 30Y, 30M, 30C, and 30K can be used only in the first image forming apparatus 1 and are prevented from being used in the second image forming apparatus 100. Similarly, the second toner containers 130Y, 130M, 130C, and 130K can be used only in the second image forming apparatus 100 and are prevented from being used in the first image forming apparatus 1.

Therefore, with reference to FIGS. 4A and 5A, the incompatible shapes of the container-side coupling portions 30Y10, 30M10, 30C10, and 30K10 of the first toner containers 30Y, 30M, 30C, and 30K are different from the incompatible shapes of the container-side coupling portions 130Y10, 130M10, 130C10, and 130K10 of the second toner containers 130Y, 130M, 130C, and 130K. The first toner container 30Y, 30M, 30C, and 30K and the second toner container 130Y, 130M, 130C, and 130K share a common component as a container except for the incompatible shapes of the container-side coupling portions 30Y10, 30M10, 30C10, and 30K10; and 130Y10, 130M10, 130C10, and 130K10.

Corresponding to such a difference in shape of the container-side coupling portion, the incompatible shape of the apparatus-side coupling portion 28*a* of the container mount 28 of the first image forming apparatus 1 is different from an incompatible shape of an apparatus-side coupling portion 128*a* of the container mount 128 of the second image forming apparatus 100. The first container mount 28 and the second container mount 128 share a common component except for the incompatible shapes of the apparatus-side coupling portions 28*a* and 128*a*.

With such a configuration, as illustrated in FIG. 4B, the second toner containers 130C and 130K are not installable in the first container mount 28, and as illustrated in FIG. 5B, the first toner containers 30C and 30K are not installable in the second container mount 128. That is, the incompatibility between the first toner containers 30Y, 30M, 30C, and 30K and the second toner container 130Y, 130M, 130C, and 130K is ensured between the different types of the image forming apparatuses 1 and 100, respectively.

Similarly to the first image forming apparatus 1, the plurality of toner containers (developer containers) 130Y, 130M, 130C, and 130K is installable in the second container mount 128 of the second image forming apparatus 100 only when arranged in the correct order (e.g., Y, M, C, and K).

As described above, the image forming apparatus 1 according to the above embodiments includes the plurality of toner containers 30Y, 30M, 30C, and 30K as a plurality of developer containers configured to contain toners of different colors as different types of developers, and the container mount 28 in which the plurality of toner containers 30Y, 30M, 30C, and 30K is removably installed and arranged adjacent to each other. In addition, the plurality of toner containers 30Y, 30M, 30C, and 30K includes the concave-convex portions 30Y1, 30M1 and 30M2, 30C1 and 30C2, and 30K1 as engagement portions, respectively. The concave-convex portions 30Y1, 30M1, 30M2, 30C1, 30C2, and 30K1 engage the corresponding concave-convex portions 30Y1, 30M1, 30M2, 30C1, 30C2, and 30K1 disposed adjacent to each other when the plurality of toner containers 30Y, 30M, 30C, and 30K is installed in the container mount 28 in the predetermined order (e.g., Y, M, C, and K), to allow the plurality of toner containers 30Y, 30M, 30C, and 30K to be installed. On the other hand, the concave-convex portions 30Y1, 30M1, 30M2, 30C1, 30C2, and 30K1 interfere with the corresponding concave-convex portions 30Y1, 30M1, 30M2, 30C1, 30C2, and 30K1 adjacent each other when the plurality of toner containers 30Y, 30M, 30C, and 30K is installed in the container mount 28 in the different order from the predetermined order (e.g., Y, M, C, and K), to prevent the plurality of toner containers 30Y, 30M, 30C, and 30K from being installed.

As a result, the flexibility to design the container mount 28 (the image forming apparatus 1) is high, and the plurality of toner containers 30Y, 30M, 30C, and 30K that contains toners (developers) of different colors (types) is prevented from being installed in the container mount 28 in the different order from the predetermined order (e.g., Y, M, C, and K).

Therefore, according to the present disclosure, an image forming apparatus can be provided in which the flexibility to design the image forming apparatus is high, and a plurality of developer containers that contains different types of developers is prevented from being installed in a container mount in a different order from a predetermined order.

It is to be noted that, although the toner containers 30Y, 30M, 30C, and 30K contain only toner as a developer in the above-described embodiments, alternatively, a toner container may contain a two-component developer including toner and carrier to be used in image forming apparatuses in which the two-component developer is supplied to a developing device.

Additionally, although the toner containers 30Y, 30M, 30C, and 30K having the substantially rectangular-parallelepiped shape are removably installed in the image forming apparatus 1 in the above-described embodiments, the shape of the toner container is not limited thereto. This disclosure can be applied to image forming apparatuses, in which, for example, a cylindrical or polygonal prismatic toner container is installed.

In the above-described embodiments, the toner containers 30Y, 30M, 30C, and 30K include the engagement portions that are the concave-convex portions 30Y1, 30M1, 30M2, 30C1, 30C2, and 30K1. However, the shape of the engagement portions is not limited thereto and can be any shape as long as the engagement portions engage each other only when the plurality of toner containers 30Y, 30M, 30C, and 30K is installed in the correct order.

All of the cases described above exhibit effects similar to those of the above-described embodiments.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. An image forming apparatus comprising:

a plurality of developer containers configured to contain different types of developers; and a container mount in which the plurality of developer containers is removably installed and arranged adjacent to each other, each of the plurality of developer containers including an engagement portion, the engagement portion of one of the plurality of developer containers configured to engage the engagement portion of another of the plurality of developer containers disposed adjacent to the one of the plurality of developer containers when the plurality of developer containers is installed in the container mount in a predetermined order, to allow the plurality of developer containers to be installed, the engagement portion of the one of the plurality of developer containers configured to interfere with the engagement portion of the another of the plurality of developer containers disposed adjacent to the one of the plurality of developer containers when the plurality of developer containers is installed in the container mount in a different order from the predetermined order, to prevent the plurality of developer containers from being installed.

2. The image forming apparatus according to claim 1, wherein the engagement portion of each of the plurality of developer containers is configured not to interfere with the container mount when the plurality of developer containers is installed in the container mount in the predetermined order, to allow the plurality of developer containers to be installed, and wherein the engagement portion of at least the one of the plurality of developer containers is configured to interfere with the container mount when the plurality of developer containers is installed in the container mount in the different order, to prevent the plurality of developer containers from being installed.

3. The image forming apparatus according to claim 1, wherein the plurality of developer containers is removably installed in the container mount along an installation direction to install and remove the plurality of developer containers, and wherein the engagement portion of each of the plurality of developer containers is a concave-convex portion extending along the installation direction.

4. The image forming apparatus according to claim 1, wherein the container mount includes an apparatus-side coupling portion having an incompatible shape between different types of image forming apparatuses, wherein each of the plurality of developer containers includes a container-side coupling portion having an incompatible shape between different types of image forming apparatuses, wherein the apparatus-side coupling portion and the container-side coupling portion are configured to engage each other to allow each of the plurality of developer containers to be installed in the image forming apparatus of same type, and wherein the container-side coupling portion is configured to interfere with an apparatus-side coupling portion of an image forming apparatus of a different type to prevent each of the plurality of developer containers from being installed in the image forming apparatus of the different type.

5. The image forming apparatus according to claim 1, wherein each of the plurality of developer containers includes a container-side mark to identify a corresponding one of the different types of developers in the plurality of developer containers, and wherein the container mount includes an apparatus-side mark to indicate the predetermined order or a position where each of the plurality of developer containers is installed.

6. The image forming apparatus according to claim 1, wherein the different types of developers are toners of different colors, and wherein the plurality of developer containers is configured to contain the toners of different colors.

* * * * *